United States Patent [19]

Kerschner

[11] 4,351,622

[45] Sep. 28, 1982

[54] EXPANSION SEAL

[75] Inventor: James J. Kerschner, Tonawanda, N.Y.

[73] Assignee: Acme Highway Products Corporation, Amherst, N.Y.

[21] Appl. No.: 218,701

[22] Filed: Dec. 22, 1980

[51] Int. Cl.[3] ..... E01C 11/10

[52] U.S. Cl. ..... 404/64; 52/396; 49/475

[58] Field of Search ..... 404/68, 69, 47, 64, 404/65; 52/396, 403; 49/475

[56] References Cited

U.S. PATENT DOCUMENTS

| | | | |
|---|---|---|---|
| 3,682,053 | 8/1972 | Kerschner | 404/65 |
| 3,994,609 | 11/1976 | Puccio | 404/69 |
| 4,067,660 | 1/1978 | Puccio | 404/65 X |
| 4,098,043 | 7/1978 | McCready | 404/64 X |
| 4,148,167 | 4/1979 | Puccio | 404/65 X |
| 4,179,226 | 12/1979 | Puccio | 404/69 X |
| 4,271,650 | 6/1981 | Jones | 404/69 X |

*Primary Examiner*—Nile C. Byers, Jr.
*Attorney, Agent, or Firm*—Christel, Bean & Linihan

[57] ABSTRACT

A seal having an elongated body including a mounting portion extending along its longitudinal edges for securement to a pair of spaced-apart structural members defining a gap therebetween in an expansion joint assembly. The seal has an intermediate expansion portion formed integral with the mounting portion and having an upper treadway surface formed with at least three integrally connected corrugated members each having a central, substantially planar surface and a pair of inclined legs extending downwardly and outwardly to form a substantial V-shaped groove at the joinder of adjacent legs, the outermost legs being integrally connected to the mounting portions. A lower expansible section is formed with at least two laterally spaced protuberances and an integral connecting section joining the protuberances. A plurality of nonintersecting struts connect the V-shaped junctures of the corrugated upper treadway surface with the lower expansible section substantially at the junctures between the protuberances and the connecting section. Additional struts extend downwardly and outwardly from the upper treadway surface to the lower expansible section adjacent the junctures between the intermediate expansion portion and the mounting portions.

7 Claims, 4 Drawing Figures

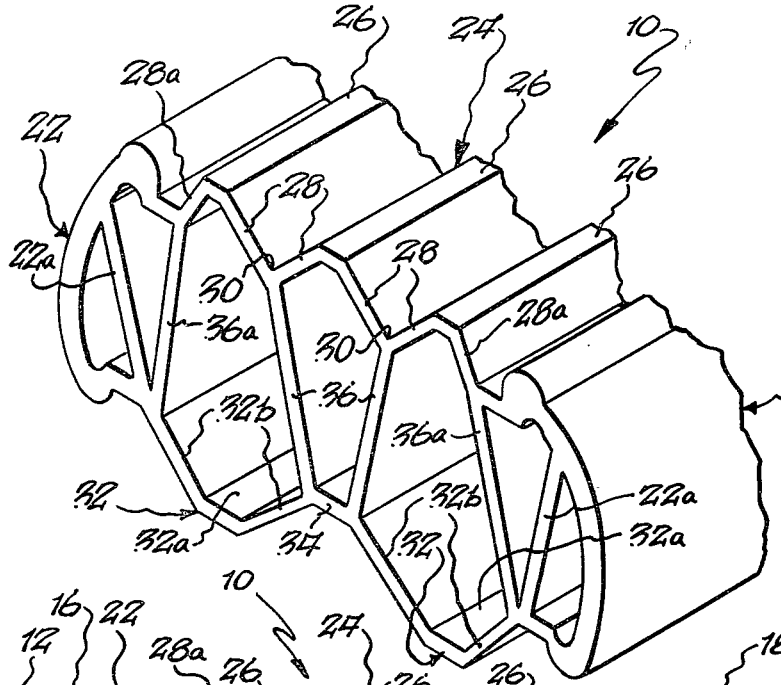
Fig. 1.
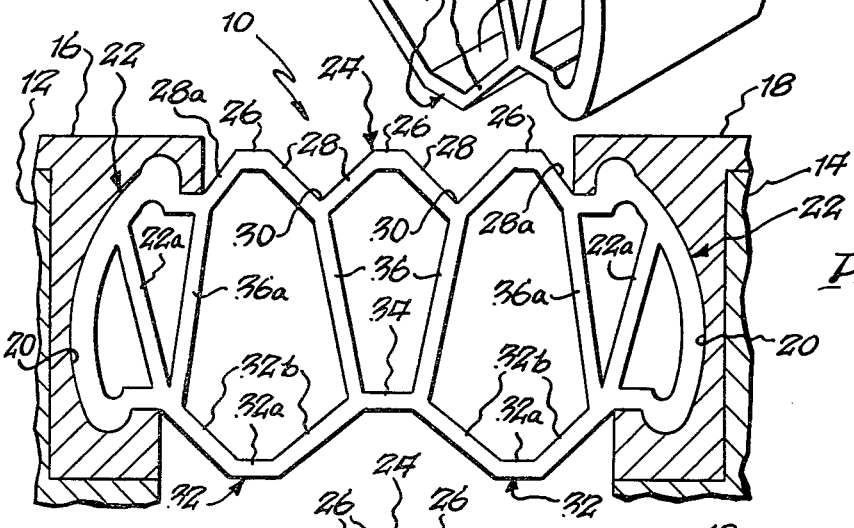
Fig. 2.
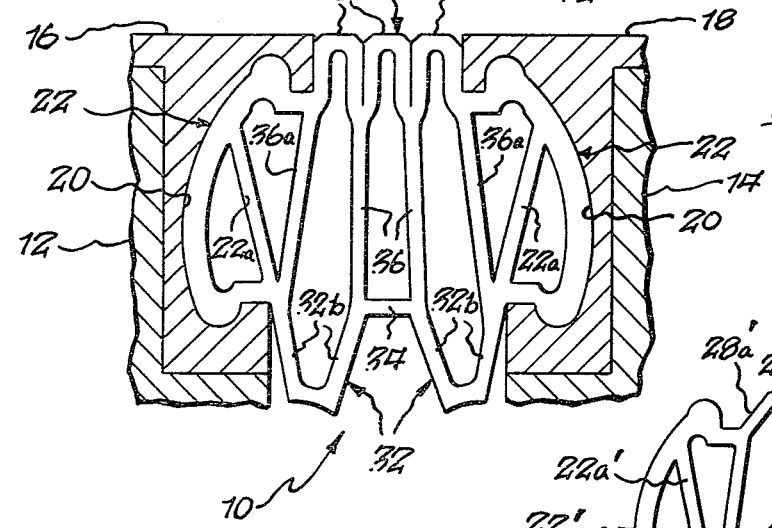
Fig. 3.
Fig. 4.
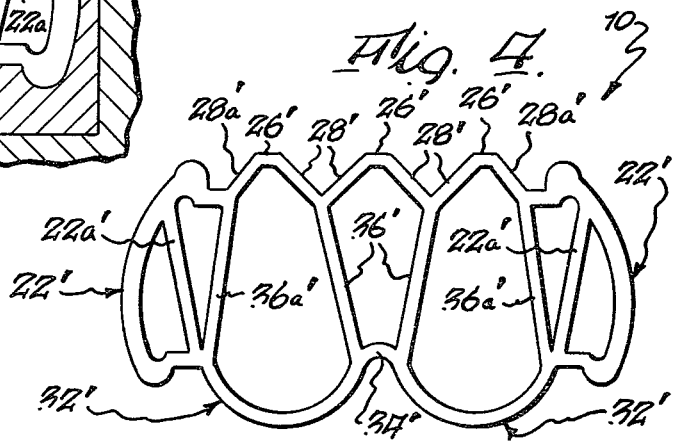

EXPANSION SEAL

BACKGROUND OF THE INVENTION

The present invention relates to an expansion joint seal of the type used for sealing an expansion gap against the intrusion of dirt, water and other debris, as for example might be encountered by expansion joints in a pedestrian walkway. More specifically, the present invention relates to an elastomeric expansion seal that may be employed in a joint assembly wherein the seal is connected between a pair of spaced-apart, structural slab members or the like, such seal being of the type disclosed in U.S. Pat. No. 4,148,167, assigned to the assignee of this invention.

Seals of this type have mounting portions along their side edges which are inserted in cavities in edge members on opposite sides of the gap, the seal spanning the gap and being retained by the edge members as the seal undergoes expansion and compression. It is important that the mounting portions be securely retained in the edge members, that the seal have a sufficient expansion capacity, and also that the seal have sufficient strength to withstand vertically applied pressure to support the pedestrian or other loads applied thereagainst.

At the same time, it is important that the seal be capable of assembly to the edge members without undue difficulty under all field conditions expected to be encountered. This can pose a problem where only relatively minimal gap width is available for insertion of a seal having the capability of expanding to seal a much greater gap width.

SUMMARY OF THE INVENTION

Accordingly, it is an object of the present invention to provide an expansion seal of the aforesaid type capable of undergoing substantial expansion and which can be collapsed in a manner facilitating insertion of the mounting portions in structural edge members.

The expansion seal of the present invention is constructed to provide in the movable portions thereof sufficient spacing to accomplish the foregoing while at the same time providing proper sealing relationship with the structural slab and edge members and also maintaining adequate vertical strength to support the pedestrian loadings applied to the treadway surface thereof.

The foregoing and other objects, advantages and characterizing features of the present invention will become clearly apparent from the ensuing detailed description of an illustrative embodiment thereof, taken together with the accompanying drawing wherein like reference characters denote like parts throughout the various views.

BRIEF DESCRIPTION OF THE DRAWINGS

FIG. 1 is a fragmentary perspective view of an expansion seal according to the present invention;

FIG. 2 is a vertical sectional view thereof depicting the same in position bridging the gap between a pair of spaced structural members;

FIG. 3 is a view similar to FIG. 2 depicting the seal in substantially fully compressed condition; and FIG. 4 is an end view of a slightly modified seal in accordance with the present invention.

DETAILED DESCRIPTION OF THE ILLUSTRATED EMBODIMENTS

Referring in detail to the illustrative embodiments depicted in the accompanying drawing, there is shown in FIG. 1 an elongated, resiliently yieldable expansion seal, generally designated 10, which is constructed in accordance with this invention.

Sealing member 10 preferably is composed of a resiliently yieldable elastomeric material, such as neoprene, for example, or any other elastic material having similar properties of durability, sufficient compression and expansion capabilities, and high abrasion resistance and which is capable of withstanding temperature extremes, sunlight, weathering, oxidation and deleterious chemicals. Seal 10 is a member of unitary, one-piece construction formed by a suitable extrusion process and can be of any length desired. While sealing member 10 can take various outside dimensions to conform to the width of the gap which it is to span, the width generally is of a greater dimension than the height or vertical extent thereof. Also, it should be understood that although sealing member 10 is especially adapted for use between adjacent pavement slabs of a concourse or walkway, it has general utility in various expansion joint applications such as those employed in highways, sidewalks, airfields, building structures and the like. In this connection, it is to be noted that various terms such as "vertical", "horizontal", "upper", "lower", "lateral" and the like employed in connection with this description of the invention are used for convenience and ease in describing the same; and it is to be understood that the present invention is not limited by the particular orientation the expansion seal member 10 may take.

In FIG. 2, expansion seal 10 is shown bridging a gap between a pair of structural slab members 12 and 14 which can be of concrete, metal or other suitable material such as might be found in a walkway or concourse construction. Slab members 12 and 14 preferably are provided with a pair of longitudinally extending structural edge members 16 and 18 which are permanently affixed to or embedded in the slab members for mounting the seal; such edge members being shown as metal extrusions although they can be formed of concrete, fiberglass reinforced plastic or other suitable materials. As illustrated in FIGS. 2 and 3, each structural edge member 16, 18 includes a C-shaped cavity 20 having a preselected radius of curvature wherein each of the cavities opens towards the gap between the slab and edge members.

Mounting portions 22 in the form of mounting beads and having stiffening cross-bars **22*a* are integrally formed along the longitudinal side edges of seal member 10 for receipt within the cavities 20 for securing seal 10 in place within the edge members. The structure and function of these mounting beads in coaction with the C-shaped cavities are described in U.S. Pat. No. 4,148,167; therefore no further description is deemed necessary herein. The mounting beads 22 are integrally connected to an intermediate expansion section 24 of the seal member 10 for bridging the gap between the structural slab and edge members, section 24** expanding as the slab members contract and being compressed as they expand, such expansion and contraction being due to environmental changes or the like.

In accordance with the present invention, intermediate expansion portion 24 comprises an upper treadway surface formed with at least three corrugated members, each having a central, substantially planar horizontal tread surface 26 and a pair of inclined, downwardly and outwardly depending legs 28 integral therewith and extending therefrom to form a plurality of substantially V-shaped grooves 30 at the juncture of legs 28, the outermost legs 28*a* being joined to the mounting beads 22. The intermediate expansion section 24 further includes a lower expansible section having at least two protuberances 32 spaced below and substantially vertically aligned with the outer two planar treadway surfaces 26. As depicted, these protuberances 32 project in a direction away from the corrugated upper treadway surface, and are connected to each other by an integrally formed connecting section 34 which is substantially vertically aligned with the center tread 26. In the embodiment illustrated in FIGS. 1, 2 and 3, protuberances 32 each comprise a substantially planar central section 32*a* having a pair of legs 32*b* connected thereto and extending upwardly and outwardly therefrom, with the outermost legs joined to the mounting beads 22. The connecting section 34 is substantially planar, spaced upwardly and inwardly of the planar central sections 32*a* and integrally connected to the innermost legs 32*b*. The lateral extent of the protuberances 32, including the sections 32*a* and 32*b* thereof, is greater than the lateral extent of the outermost, upper treadway surfaces 26, 28, 28*a* with which they are substantially vertically aligned, whereas the lateral extent of the connecting section 34 is less than that of the central treadway surface 26, 28 with which it is in substantial vertical alignment.

Completing the structure of the intermediate expansion section 24 are a plurality of nearly vertical struts 36, 36*a* connected to the upper treadway surface 26 and the lower expansible section 32 so as to give sufficient rigidity and vertical strength to the seal 10, while permitting the same to undergo a relatively large degree of compression to facilitate placement of seal 10 in edge members 16, 18. More specifically, outermost struts 36*a* are connected to and extend between the lower ends of the outermost legs 28*a* of the upper treadway section and the upper ends of the outermost legs 32*b* of protuberances 32 to define a pair of downwardly and outwardly inclined strut members at the outer extremities of intermediate section 24 adjacent the mounting bead portions 22 of the seal. The innermost struts 36 are connected at their upper ends to the juncture of upper legs 28 and at their lower ends to the junctures of connecting section 34 and legs 32*b*, thereby to define a pair of downwardly and normally inwardly inclined strut members. The arrangement is such that each outermost strut 36*a* defines, with the adjacent strut 36 and the upper and lower seal sections extending therebetween, an open-ended, closed-wall tubular cell having a widened lower base with a downwardly protruding central section. Similarly, the innermost struts 36 define, with the upper and lower seal sections extending therebetween, an open-ended, closed-wall tubular cell having a widened upper wall and a reduced lower base which is spaced inwardly above the widened-base channels.

It should be apparent that the widened protuberances 32 together with the spaces between nonintersecting struts 36, 36*a* permit a substantial collapsing the expansion section 24 without blocking abutment of the struts, as shown in FIG. 3, thereby facilitating placement of seal 10 between edge members 16, 18 and insertion of mounting beads 22 in the cavities thereof. At the same time, sufficient vertical strength is provided to support vertical pedestrian loadings without collapsing. As can be seen from the compressed position of FIG. 3, struts 36 assume a nearly vertical position to thereby add vertical strength to the seal in all positions thereof throughout its operative range of movement. Further, it should be apparent that very little "growth" takes place as the seal moves to its contracted position, to thereby maintain the upper surface substantially flush with the upper surface of edge members 16, 18 and the adjacent pavement.

Although the embodiment of FIGS. 1, 2 and 3 depicts the lower protuberances 32 and connecting section 34 as comprising planar surfaces and inclined legs, it is within the purview of the present invention to include curved lower surfaces as well. To this end, the embodiment of FIG. 4 illustrates a modified expansion seal 10' comprising a pair of curved protuberances 32' interconnected by an oppositely curved, integrally formed connecting section 34'. Stiffening struts 22*a'* are rotated to be more nearly vertical. In all other respects, the embodiment of FIG. 4 is the same as that previously described with respect to FIGS. 1, 2 and 3, corresponding parts having the same reference numerals, with primes.

Although preferred embodiments of the present invention have been disclosed and described in detail, changes will occur to those skilled in the art. Therefore, it is intended that the present invention be limited only by the scope of the appended claims.

What is claimed is:

1. A seal adapted to be connected between a pair of spaced-apart structural members defining a gap therebetween in an expansion joint assembly, said seal comprising:

an elongated body having longitudinal edges and including a mounting portion extending along each of its longitudinal edges for coaction with the structural members in the installed position of said seal; and an intermediate expansion portion formed integral with said mounting portions comprising;

an upper treadway surface formed with at least three integrally connected corrugated members, each of said corrugated members having a substantially planar central surface and a pair of downwardly and outwardly inclined legs extending from said central surface, the legs of adjacent corrugated members being joined and defining at the joinder thereof a substantially V-shaped groove, the outer legs of the outermost corrugated members being integrally connected to said mounting portions, a lower expansible section spaced vertically below said upper treadway surface and formed with at least two laterally spaced protuberances which are in substantial vertical alignment with said central surface of said outermost corrugated members, said lower expansible section including an integrally formed connecting section joining said protuberances, and a plurality of nonintersecting, non-joined struts extending between said upper treadway surface and said lower expansible section, said struts connecting said joined legs of said corrugated upper treadway surface with said lower expansible section substantially at the junctures of said protuberances with said connecting section.

2. The improved seal according to claim 1, wherein:

said protuberances are defined by a central, substantially planar surface and a pair of legs extending upwardly and outwardly therefrom with the innermost legs of said protuberances integrally joining said connecting section.

3. The improved seal according to claim 2, further comprising:

an additional pair of struts extending downwardly and outwardly from said upper treadway surface to said lower expansible section and integrally connecting the outermost legs of said corrugated members to the outermost legs of said protuberances.

4. The improved seal according to claim 3, wherein:

each said mounting portion is a substantially C-shaped, beaded member.

5. The improved seal according to claim 1, wherein:

said protuberances comprise outwardly curved members; and said connecting section comprises an inwardly curved member.

6. The improved seal according to claim 5, further comprising:

an additional pair of struts extending downwardly and outwardly from said upper treadway surface to said lower expansible section and integrally connecting said outermost legs of said corrugated members to the outermost portions of said curved protuberances.

7. The improved seal according to claim 6, wherein:

each said mounting portion is a substantially C-shaped, beaded member.

* * * * *